US008179406B2

(12) United States Patent
Mori et al.

(10) Patent No.: US 8,179,406 B2
(45) Date of Patent: May 15, 2012

(54) CONTROL APPARATUS AND METHOD FOR IMAGE DISPLAY

(75) Inventors: Makiko Mori, Kanagawa (JP); Muneki Ando, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 579 days.

(21) Appl. No.: 12/419,595

(22) Filed: Apr. 7, 2009

(65) Prior Publication Data

US 2009/0262248 A1 Oct. 22, 2009

Related U.S. Application Data

(62) Division of application No. 11/210,824, filed on Aug. 25, 2005, now Pat. No. 7,561,171, which is a division of application No. 10/287,625, filed on Nov. 5, 2002, now Pat. No. 6,987,521.

(30) Foreign Application Priority Data

Nov. 8, 2001 (JP) ..... 2001-343250

(51) Int. Cl.
*G09G 5/10* (2006.01)

(52) U.S. Cl. ..... 345/690; 345/63; 345/77; 345/214; 345/426; 345/589; 345/691; 382/167; 382/270; 382/274

(58) Field of Classification Search ..... None
See application file for complete search history.

(56) References Cited

U.S. PATENT DOCUMENTS

| | | | | |
|---|---|---|---|---|
| 5,801,765 | A | 9/1998 | Gotoh et al. | 348/155 |
| 5,847,504 | A | 12/1998 | Baldi | 313/495 |
| 6,204,608 | B1 | 3/2001 | Song et al. | 315/169.3 |
| 6,624,590 | B2 | 9/2003 | Russ et al. | 315/169.3 |
| 6,636,209 | B2 | 10/2003 | Ono et al. | 345/211 |
| 6,643,398 | B2 | 11/2003 | Moriwaki | 382/167 |
| 6,690,388 | B2 | 2/2004 | Kasahara et al. | 345/690 |
| 6,987,521 | B2 | 1/2006 | Mori et al. | 345/690 |
| 7,561,171 | B2 * | 7/2009 | Mori et al. | 345/690 |

FOREIGN PATENT DOCUMENTS

| | | | |
|---|---|---|---|
| EP | 0 656 726 | A1 | 1/1994 |
| EP | 0 965 974 | | 12/1999 |
| EP | 1 022 714 | A2 | 1/2000 |
| JP | 03-214364 | A | 9/1991 |
| JP | 2000-250463 | | 9/2000 |
| JP | 2000-250463 | A | 9/2000 |
| JP | 2000-330505 | A | 11/2000 |
| JP | 2001-056665 | A | 2/2001 |
| JP | 2001-69507 | A | 3/2001 |

OTHER PUBLICATIONS

European Summons to Attend Oral Proceedings Pursuant to Rule 115(1) EPC, dated Jul. 30, 2009, regarding Application No. 02024752.4-1228/1310935.

EPO Search Report for counterpart Application No. 02024752.4-1228, Jul. 30, 2009.

* cited by examiner

*Primary Examiner* — Antonio A Caschera
(74) *Attorney, Agent, or Firm* — Fitzpatrick, Cella, Harper & Scinto

(57) ABSTRACT

A detection unit which includes an image display panel, brightness averaging unit, scene changeover detection unit, and brightness suppression unit in order to provide an image display apparatus having an ABL that does not give the observer any visual sense of incompatibility without increasing the circuit scale determines the presence/absence of a scene changeover on the basis of the frame differential or second order differential of the average brightness. If a scene changeover takes place, the display brightness is changed quickly, and if no scene changeover occurs, changed slowly.

9 Claims, 12 Drawing Sheets

CONTROL APPARATUS AND METHOD FOR IMAGE DISPLAY

CROSS REFERENCE TO RELATED APPLICATION

This application is a division of U.S. patent application Ser. No. 11/210,824, filed on Aug. 25, 2005 now U.S. Pat No. 7,561,171, which is a division of U.S. patent application Ser. No. 10/287,625, filed Nov. 5, 2002 (now U.S. Pat. No. 6,987, 521 B2, dated Jan. 17, 2006), which are incorporated by reference herein in their entirety, as if fully set forth herein, and claims the benefit of priority under 35 U.S.C.§119, based on Japanese Priority Application No. JP 343250/2001, filed Nov. 8, 2001, which is incorporated by reference herein in its entirety, as if fully set forth herein.

BACKGROUND OF THE INVENTION

1. Field of the Invention

The present invention relates to an image display and, more particularly, to a control apparatus and method for an image display having an ABL (Auto-Brightness Limitation circuit).

2. Related Background Art

Some image displays comprise ABLs (Auto-Brightness Limitation circuits) for limiting the display brightness. The ABL generally suppresses and controls the average display brightness of the screen so as not to excessively increase it for the purpose of suppression of power consumption or the like. The control response speed is preferably higher in terms of suppression of power consumption. However, an excessively high speed makes the display brightness of the screen unstable when the average brightness changes between frames (fields) of the same scene. The display brightness is generally controlled with a response slowed down with a given time constant.

With such a slow response, control is performed with a delay after the image brightness changes when, for example, the image brightness greatly changes within a short period upon a scene changeover. No control is done immediately when the image brightness changes greatly. The image brightness gradually changes with a delay. Such a change of the brightness gives the image observer a visual sense of incongruity or incompatibility.

To solve this problem, the present applicant has proposed an image display control apparatus as disclosed in Japanese Laid-Open Gazette No. 2000-250463. In this Gazette, there is disclosed a control apparatus and method for an image display that can suppress any increase in power consumption and heat generation on the display surface by controlling the display brightness in response to a change of a video signal, and also prevent any visual sense of incongruity or incompatibility by control.

In this Gazette, in order to detect the frame correlation, the sum of the absolute values of differences between frames of a color difference signal for each block prepared by dividing the display area must be calculated, resulting in a large-scale processing circuit.

The present invention has been made to overcome the conventional drawbacks, and has as its object to provide a control apparatus and method for an image display that can suppress any increase in power consumption of the image display and heat generation on the display surface by controlling the display brightness in response to a change of a video signal, prevent any visual sense of incongruity or incompatibility by control, and suppress any increase in circuit scale.

SUMMARY OF THE INVENTION

An image display control apparatus according to the present invention comprises: brightness information means for obtaining brightness information corresponding to an average brightness of a display image; detection means for detecting an image scene changeover on the basis of a change amount of the brightness information; and brightness suppression means for suppressing a display brightness, wherein said brightness suppression means suppresses the display brightness in response to the brightness information and detection of the scene changeover.

The above apparatus takes the following embodiments. When no scene changeover is detected, said brightness suppression means so controls as to slowly change the display brightness, and when the scene changeover is detected, so controls as to change the display brightness more quickly than when no scene changeover is detected.

The brightness suppression means linearly changes the display brightness as a function of time when no scene changeover is detected.

The detection means detects the scene changeover on the basis of a difference between an average brightness of a frame of interest and an average brightness of an immediately preceding frame.

The detection means detects the scene changeover on the basis of a second order differential of the average brightness.

The detection means determines the change amount of the average brightness for each component signal of an input video signal.

The brightness information means detects the average brightness for each of a plurality of areas obtained by dividing a display area of display means, and the detection means detects the scene changeover for each of the plurality of areas on the basis of the average brightness of each of the plurality of areas, and detects the scene changeover for the entire display area with combining scene changeovers for the plurality of areas.

The detection means determines based on a display mode whether to select scene changeover information for each of the plurality of areas.

Display means driven by the apparatus according to the present invention comprises a plurality of electron-emitting devices arranged in a matrix via column wiring and row wiring, and displays an image by irradiating phosphor with an electron beam emitted by the electron-emitting devices.

The brightness suppression means suppresses the brightness by changing a brightness component of a video signal.

The brightness suppression means suppresses the brightness by changing a drive voltage of the electron-emitting devices.

The brightness suppression means suppresses the brightness by changing an acceleration voltage for accelerating electrons emitted by the electron-emitting devices.

The brightness information means obtains the average brightness of the display image.

The brightness information means obtains the brightness information corresponding to the average brightness of the display image by detecting an emission current emitted by the electron-emitting devices.

The electron-emitting devices are surface conduction electron-emitting devices.

An image display control method according to the present invention comprises detecting a scene changeover from brightness information corresponding to an average brightness of a display image; and suppressing a display brightness exceeding a target value in response to the brightness information and detection of the scene changeover.

When no scene changeover is detected, the display brightness is so controlled as to change slowly, and when the scene changeover is detected, the display brightness is so controlled as to change more quickly than when no scene changeover is detected.

In one aspect of the present invention, an image display control apparatus of displaying an image of frame or field on a display in response to an input image signal, comprises:

An auto-brightness limitation circuit for transforming the input image signal with a limitation coefficient to produce a display brightness signal to be applied to the display, the limitation coefficient being a ratio of the display brightness signal to the input brightness signal and being determined to limit the display brightness signal to a brightness referential level specific to the display with a predetermined time constant of time-variation of the limitation coefficient; and A detection circuit for detecting a scene changeover when a change of brightness in the input image signal from one frame or field to a succeeding frame or field is larger than a predetermined threshold, wherein said auto-brightness limitation circuit reduces the predetermined time constant in response to the scene changeover detection.

The above apparatus takes the following embodiments. The detection circuit detects the scene changeover by differentiating an average brightness signal of representing average brightnesses in respective ones of successive frames or fields.

One frame or field is divided into a plurality of areas and said detection circuit checks the scene changeover for each of the plurality of areas and detects the scene changeover for one frame or field with combining all the check results for the plurality of areas.

In another aspect of the present invention, image display apparatus of displaying an image of frame or field in response to an input image signal, comprises:

a display provided with an electron source comprising a plurality of electron-emitting devices arranged in a matrix and image-forming member of phosphor against which electrons emitted from the electron source impinge;

an auto-brightness limitation circuit for transforming the input image signal with a limitation coefficient to produce a display brightness signal to be applied to the display, the limitation coefficient being a ratio of the display brightness signal to the input brightness signal and being image to limit the display brightness signal to a brightness referential level specific to the display with a predetermined time constant of time-variation of the limitation coefficient; and a detection circuit for detecting a scene changeover when a change of brightness in the input image signal from one frame or field to a succeeding frame or field is larger than a predetermined threshold, wherein said auto-brightness limitation circuit reduces the predetermined time constant in response to the scene changeover detection.

In a still another aspect of the present invention, image display control apparatus comprises:

brightness information means for obtaining brightness information corresponding to an average brightness of a display image in an input video signal;

detection means for detecting an image scene changeover on the basis of a change amount of the brightness information; and brightness control means for controlling a display signal input to the image display apparatus to suppress brightness of the display signal, wherein said brightness control means controls the display signal in response to the brightness information and detection of the scene changeover.

DETAILED DESCRIPTION OF THE PREFERRED EMBODIMENTS (First Embodiment)

Figure 1:
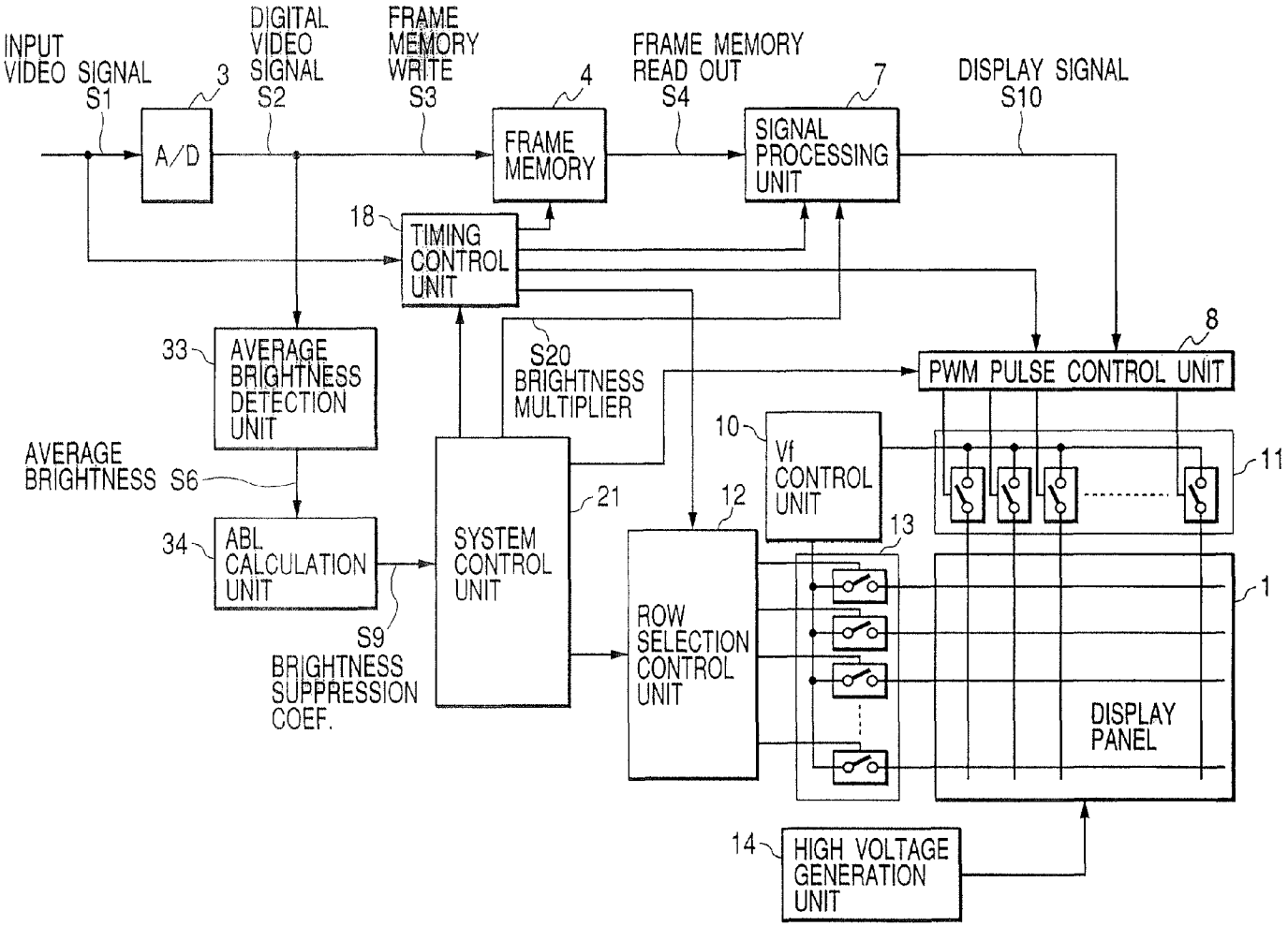
FIG. 1 is a block diagram showing the arrangement of the first embodiment.

FIG. 1 shows the arrangement of an image display apparatus according to the first embodiment. In this embodiment, a display panel 1 in FIG. 1 is a display panel in which a multi-electron source constituted by arranging many electron sources, e.g., cold cathode devices on a substrate, and an image-forming member for forming an image by electron irradiation are arranged to face each other. Electron-emitting devices are wired in a simple matrix by row- and column-directional wiring electrodes. Electrons emitted by a device selected by a row/column electrode bias are accelerated by a high voltage and impinge against the phosphor, thereby emitting light. The structure and manufacturing method of the panel are disclosed in detail in Japanese Laid-Open Gazette No. 2000-250463 described above.

An A/D converter 3 converts an input video signal into a digital signal. A frame memory 4 stores video signals of one frame. A signal processing unit 7 performs, for a video signal, processing such as brightness/chromaticity adjustment, gamma processing, edge emphasis processing, and character information synthesis.

A PWM pulse control unit 8 converts a display signal into a drive signal conforming to the display panel 1. A Vf control unit 10 controls a voltage for driving devices arranged on the display panel 1. A column wiring switch unit 11 is formed from switching means such as transistors, and applies a drive output from the Vf control unit 10 to a panel column electrode only for a PWM pulse period output from the PWM pulse control unit 8 every horizontal period (row selection period). A row selection control unit 12 generates a row selection pulse for driving devices on the display panel 1. A row wiring switch unit 13 is formed from switching means such as transistors, and outputs to the display panel 1 a drive output from the Vf control unit 10 that corresponds to a row selection pulse output from the row selection control unit 12. A high voltage generation unit 14 generates an acceleration voltage for accelerating electrons in order to make electrons emitted by electron-emitting devices arranged on the display panel 1 impinge against the phosphor.

A timing control unit 18 outputs various timing signals for the operations of blocks. A system control unit 21 controls the operations of blocks. An average brightness detection unit 33 calculates an average brightness S6 of a frame, and corresponds to an average brightness information means described in claims of the present invention. An ABL calculation unit 34 calculates an ABL brightness suppression coefficient S9 on the basis of the average brightness S6, and corresponds to a detection means described in claims of the present invention. Note that a brightness suppression means described in claims according to the first embodiment is implemented by the system control unit and signal processing unit.

A signal S1 is an input video signal. A signal S2 is a digitized video signal. A signal S3 is a video signal to be written in the frame memory. A signal S4 is a video signal read out from the frame memory. The signal S6 is the average brightness of a frame calculated by the average brightness detection unit. The signal S9 is an ABL brightness suppression coefficient calculated by the ABL calculation unit 34. A signal S10 is a display signal processed by the signal processing unit.

In normal image display operation, an input video signal S1 is digitized into a digital video signal S2 with a necessary number of gray levels by the A/D converter 3. The digitized video signal S2 is temporarily stored in the frame memory 4, and then sent to the signal processing unit 7. A display signal S10 having undergone video signal brightness/chromaticity adjustment, gamma processing, edge emphasis processing, character information synthesis, and the like by the signal processing unit 7 is serial/parallel-converted by the PWM pulse control unit 8 every horizontal period (row selection period). The resultant signal is PWM-modulated for each column. The PWM-modulated pulse is output to the column drive output SW unit 11.

Rows of the display panel 1 are selected by outputting selection pulses to the row drive output SW unit 13 on the basis of signals obtained by sequentially shifting a start pulse synchronized with the start of the effective vertical display period every row selection period.

Figure 2:
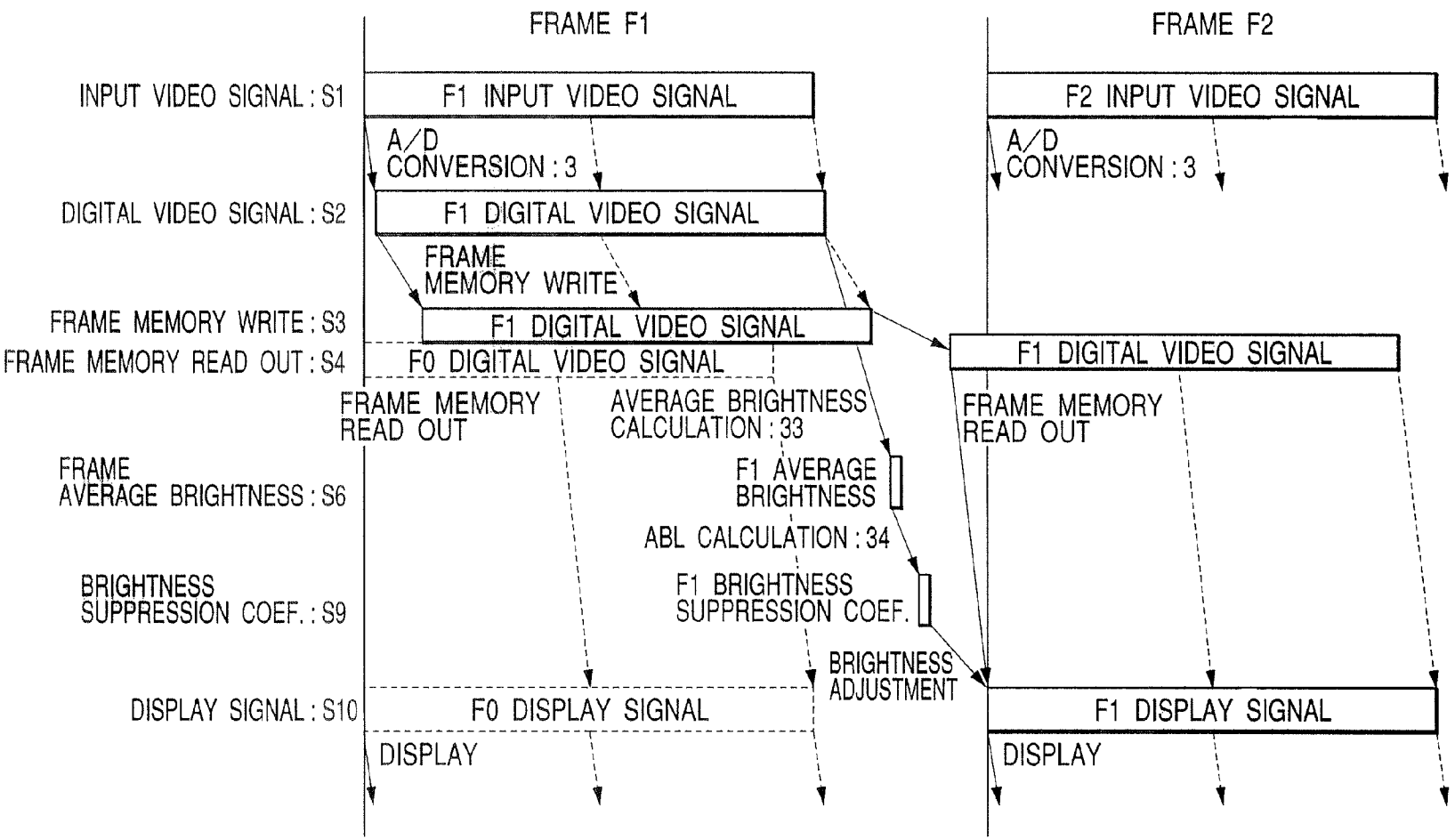
FIG. 2 is a data flow chart showing a processing flow.

FIG. 2 is a data flow chart showing a flow of data and corresponding processing steps. Processing will be explained with reference to FIGS. 1 and 2.

An input video signal S1 is digitized into a digital video signal S2 by the A/D converter 3. The digital video signal S2 is written in the frame memory 4 (S3). At the same time, the average brightness detection unit 33 calculates the average brightness S6 of a frame (field).

The average brightness S6 is input to the ABL calculation unit 34, which calculates a brightness suppression coefficient S9 for adjusting the emission brightness of the display panel 1 in accordance with the average brightness of the image. This coefficient is so calculated as to have such a relationship that the emission brightness of the display panel 1 is decreased for a higher average brightness of the image therein a predetermined referential level.

To reduce the visual influence of the image brightness caused by an abrupt change, the brightness suppression coefficient is gradually changed with a given time constant. The time constant is changed in accordance with the presence (occurrence)/absence (nonoccurrence) of an image scene changeover. If the image scene is changed over, the time constant is set small so as to quickly change the brightness suppression coefficient. While, as long as the same image scene continues, the time constant is set large so as to slowly change the brightness suppression coefficient.

The ABL brightness suppression coefficient S9 is sent to the system control unit 21, and set as the brightness multiplier of the signal processing unit 7. In accordance with the brightness multiplier (S20), the signal processing unit 7 executes arithmetic processing to a video signal S4 read out from the frame memory, generating a display signal S10.

The display signal S10 is converted by the PWM pulse control unit 8 into a drive signal for driving the display panel 1. The drive signal drives the display panel 1 to display an image.

A method of determining the emission brightness suppression coefficient of the display panel 1 will be exemplified.

Figure 3:
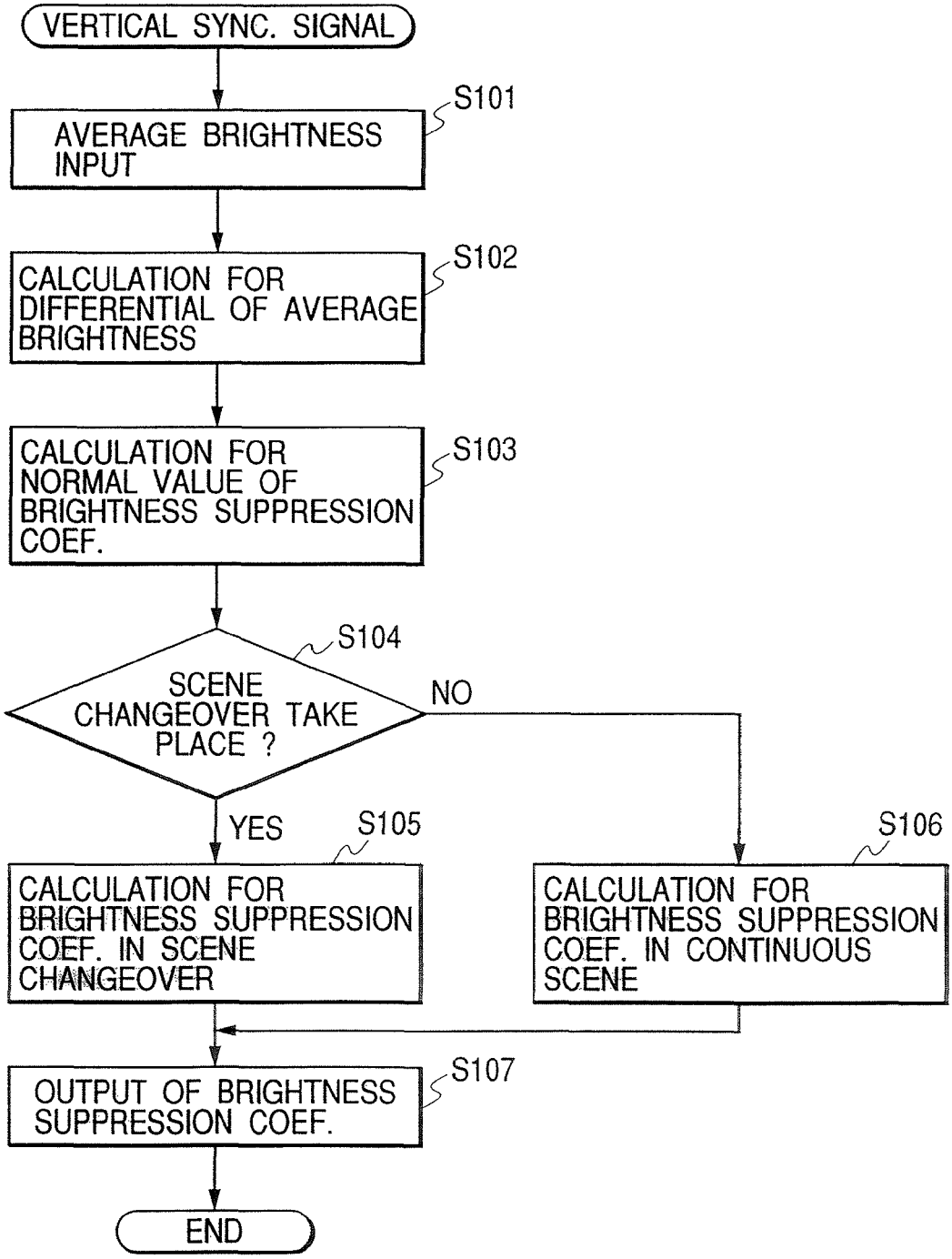
FIG. 3 is a flow chart for explaining processing of an ABL calculation unit.

FIG. 3 is a flow chart showing calculation processing of the ABL calculation unit 34. This processing is activated by a vertical sync signal supplied from the timing control unit 18, and ends within the vertical blanking period.

The average brightness S6 of an input image calculated by the average brightness detection unit 33 is input in step S101 of FIG. 3. In step S102, the difference between preceding and current frames. Letting B(t) be the average brightness of the current frame, and B (t−1) be the average brightness of the preceding frame, a difference ΔB(t) of the average brightness in the current frame is given by $$\Delta B(t)=B(t-1)-B(t) \tag{1}$$

Figure 4A:
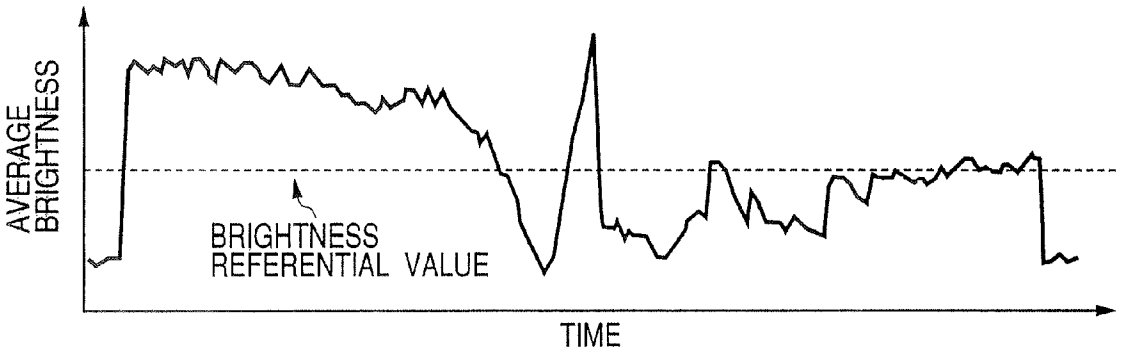
FIG. 4A is a graph showing an example of changes of the average brightness.
Figure 4B:
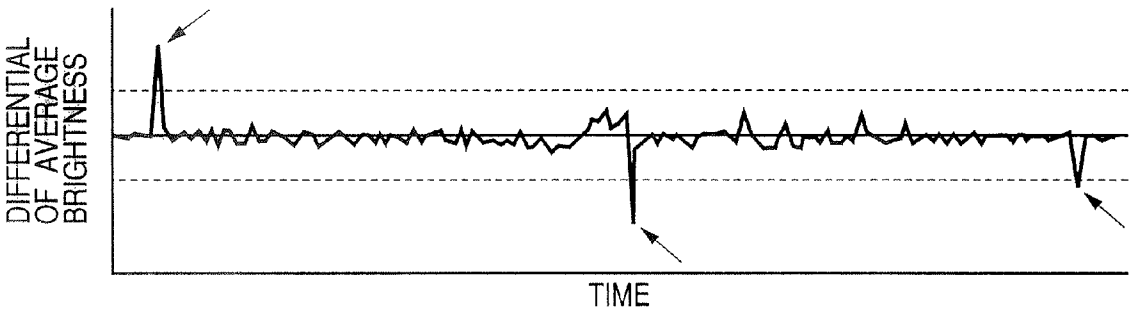
FIG. 4B is a graph showing an example of changes of the differential of the average brightness.

FIG. 4A is a graph showing an example of changes of the average brightness S6 of one frame (field). The broken line indicates a brightness referential value which is the upper limit target of the display average brightness and is set in advance. FIG. 4B is a graph showing changes of the differential of the average brightness S6 obtained from the example of FIG. 4A using equation (1).

In step S103 of FIG. 3, the normal value of the brightness suppression coefficient is calculated. Letting Bm be the brightness referential value, a normal value K(t) of the brightness suppression coefficient in the current frame is given by $$K(t)=Bm/B(t)(for\ B(t)>Bm)$$

$$K(t)=1\ (\text{for } B(t)\leqq Bm) \tag{2}$$

In step S104 of FIG. 3, whether a scene changeover has taken place is checked. This determination uses the differential of the average brightness calculated in step S102. If the absolute value of the differential of the average brightness is equal to or larger than a preset threshold, a scene changeover is determined to have taken place, and the flow branches to step S105; if No, no scene changeover is determined to have occurred, and the flow shifts to step S106.

Broken lines shown in FIG. 4B represent thresholds for determining a scene changeover, and two lines are drawn for determining a scene changeover by absolute values. In FIG. 4B, a scene changeover is determined to have taken place at three portions indicated by arrows.

If a scene changeover has taken place, a brightness suppression coefficient to be actually output to the system control unit 21 is calculated in step S105. In an image scene changeover, the time constant is set small so as to quickly change the brightness suppression coefficient. For example, as represented by equation (3), the normal value K(t) of the brightness suppression coefficient calculated in step S103 is directly employed as a brightness suppression coefficient K'(t) of the current frame:

$$K'(t)=K(t) \tag{3}$$

Alternatively, as represented by equation (4), a gain G($0 \leqq G \leqq 1$) in a scene changeover may be determined to calculate $$K'(t)=(K(t)-K'(t-1))*G+K'(t-1) \tag{4}$$

where K'(t−1) is the brightness suppression coefficient calculated for the preceding frame.

Figure 4C:
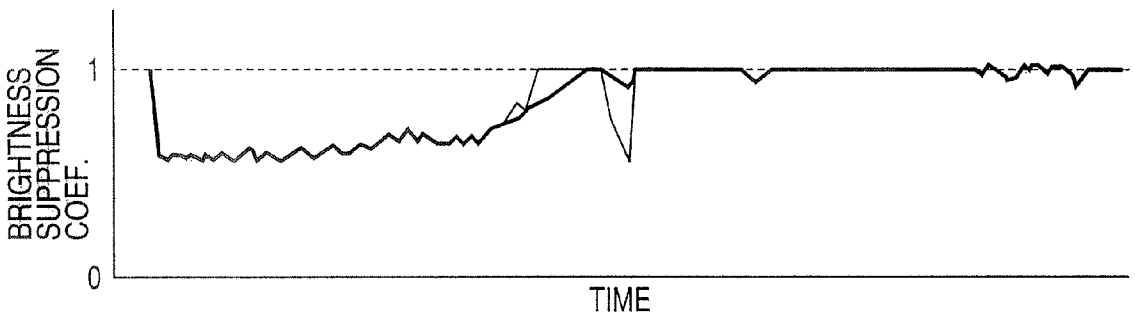
FIG. 4C is a graph showing an example of a brightness suppression coefficient.

FIG. 4C shows the graph of the brightness suppression coefficient corresponding to FIG. 4A. The solid line indicates the normal value of the brightness suppression coefficient; and the thick broken line, the brightness suppression coefficient to be actually output.

If No in step S104, a brightness suppression coefficient to be actually output to the system control unit 21 is calculated in step S106. In a continuous image scene (same scene), the time constant is set large so as to suppress the change amount of the brightness suppression coefficient small. More specifically, as represented in equation (5), a minimum step Ks of the brightness suppression coefficient is changed to make the brightness suppression coefficient gradually follow the normal value:

$$K'(t)=K'(t-1)+Ks \text{ (for } K(t)>K'(t-1))$$

$$K'(t)=K'(t-1)-Ks \text{ (for } K(t)\leqq K'(t-1)) \tag{5}$$

Alternatively, a gain g ($0 \leqq g \leqq 1$) of a continuous scene may be determined to calculate $$K'(t)=(K(t)-K'(t-1))*g+K'(t-1) \tag{6}$$

At this time, g is smaller than the gain G for a scene changeover.

The branches merge in step S107, and the brightness suppression coefficient S9 is output to the system control unit 21.

Figure 4D:
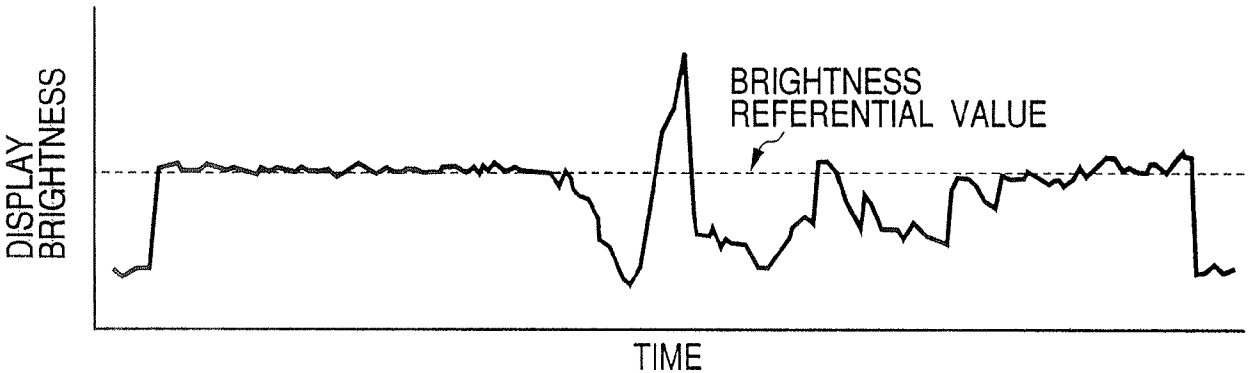
FIG. 4D is a graph showing an example of the average brightness displayed on a display panel.

FIG. 4D shows the graph of the resultant average brightness displayed on the display panel 1. At a portion where the brightness abruptly increases in a continuous scene, the brightness exceeds the brightness referential value. At remaining portions, the brightness can be controlled to be equal to or lower than the brightness referential value.

In this manner, the brightness suppression coefficient is calculated, and the display brightness is set by the system control unit 21. If the average brightness S6 is high, the brightness suppression coefficient S9 becomes low; if the average brightness S6 is low, the brightness suppression coefficient S9 becomes high. Thus, the brightness is suppressed to a predetermined value by the ABL.

When the change amount of the average brightness S6 between a frame of interest and the immediately preceding frame is small, a change of the brightness suppression coefficient is also controlled small, suppressing a change of the brightness by the ABL small. To the contrary, if the change amount of the average brightness S6 between a frame of interest and the immediately preceding frame is large, the brightness suppression coefficient is quickly controlled, and a rapid brightness convergence by the ABL becomes possible.

The first embodiment has exemplified a display using a surface conduction electron-emitting device. However, this embodiment can be practiced regardless of the structure of the display panel itself such as a CRT, PDP, electroluminescence device.

(Second Embodiment)

In the first embodiment, whether a scene changeover has taken place is determined based on the difference ΔB(t) between the current frame and the proceeding frame for the average brightness S6. In the second embodiment, whether a scene changeover has taken place is determined based on the second order differential of the average brightness S6. If the absolute value of the second order differential of the average brightness is equal to or larger than a preset threshold, a scene changeover is determined to have taken place. If the absolute value is smaller than the threshold, no scene changeover is determined to have taken place. The remaining processing is the same as that of the first embodiment, and the flow chart of FIG. 3 also applies to the second embodiment except that the second order differential replaces the differential.

Figure 4E:
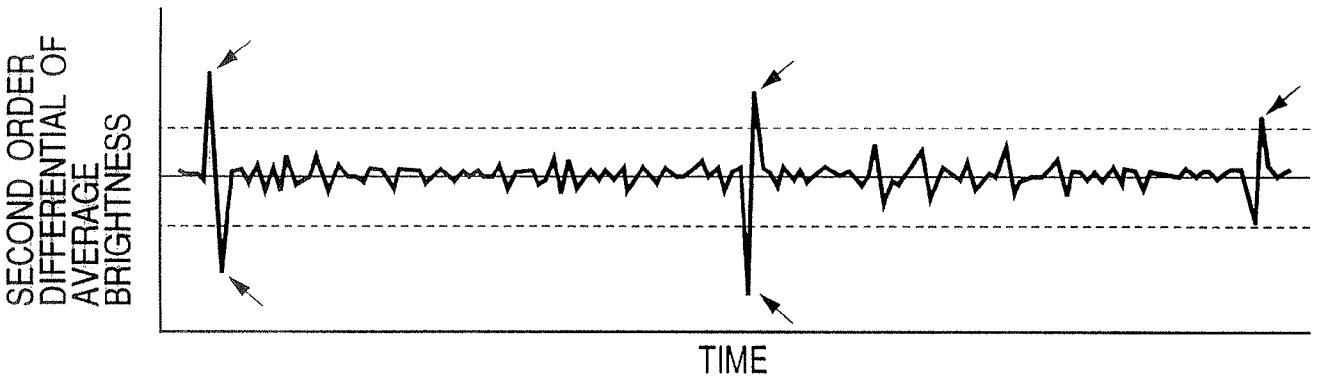
FIG. 4E is a graph showing the second order differential of the average brightness.

FIG. 4E shows the graph of the second order differential of the average brightness corresponding to FIG. 4A. Broken lines represent thresholds for determining a scene changeover, and two lines are drawn for determining a scene changeover by absolute values. In FIG. 4E, a scene changeover is determined to have taken place at five portions indicated by arrows.

The second order differential does not peak when the average brightness changes smoothly, but peaks positively and negatively when the average brightness changes as if a still image changed over (the average brightness keeps a given value for several frames, then abruptly changes to a different value, and keeps at this value for several frames). For this reason, a positive or negative peak may be detected, instead of evaluating the average brightness by an absolute value.

(Third Embodiment)

In the first and second embodiments, average brightness signals S6*r*, S6*g*, and S6*b* may be independently calculated for the respective colors of three primary color signals (R, G, and B) as component signals of the average brightness S6 when the average brightness detection unit 33 calculates the average brightness S6. The ABL calculation unit calculates differentials or second order differentials for the average brightness signals S6*r*, S6*g*, and S6*b* of the respective colors. If even one color exceeds a threshold for determining a scene changeover, a scene changeover is determined to have occurred.

When an input signal is made up of a luminance signal (Y) and color difference signals (Cb, Cr, and the like), average brightness signals Sy, Scb, and Scr are independently calculated for these component signals.

This enables detecting a scene changeover even when only the color changes while the entire brightness is kept unchanged.

(Fourth Embodiment)

In the fourth embodiment, the display area of a display panel 1 is divided into a plurality of areas, and an average brightness is calculated for each area. Scene changeover detection is executed for each area, and the results are comprehensively determined to detect a scene changeover for the whole display area.

Figure 5A:
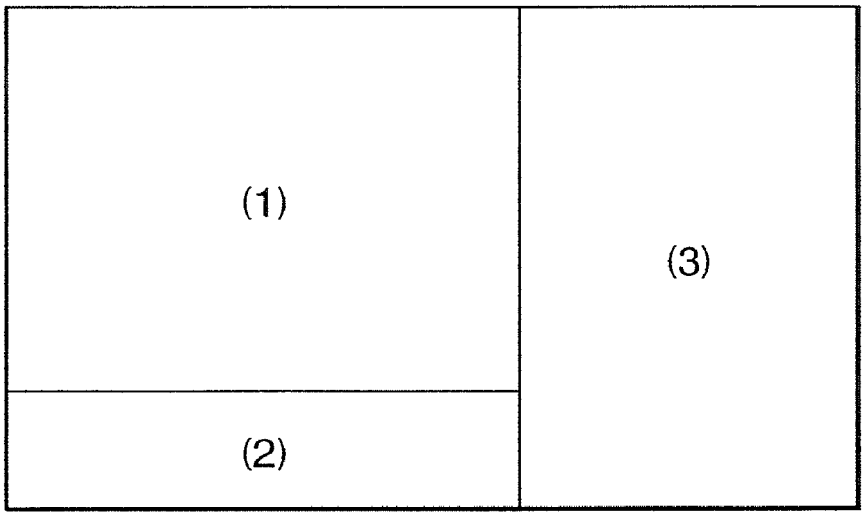
FIG. 5A is a view showing an example of the layout of a display area in a multiwindow mode according to the fourth embodiment.

FIG. 5A shows an example of the layout of a display area in a multiwindow mode. In this example, area (1) corresponds to television broadcasting; area (2), data broadcasting; and area (3), a game window. An average brightness detection unit 33 detects an average brightness for each area on the basis of a timing signal output from a timing control unit 18, and sends the average brightness to an ABL calculation unit 34. The ABL calculation unit 34 performs scene changeover detection for each area by the above-described method. If a scene changeover is determined in two or more areas, the scene changeover is determined to have occurred in the entire display area, and the ABL calculation unit 34 performs ABL processing described in detail in the first embodiment.

Figure 5B:
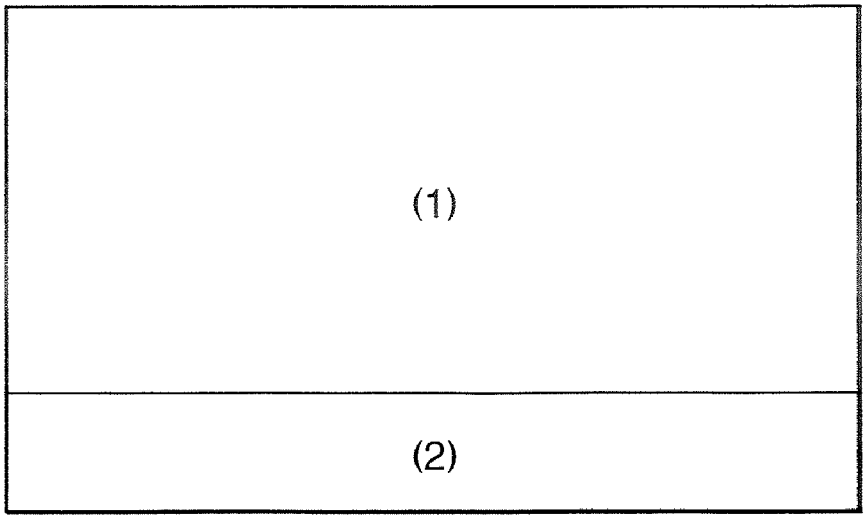
FIG. 5B is a view showing an example of the layout of the display area in another mode according to the fourth embodiment.

FIG. 5B shows the layout of a display area in a movie mode. A lower portion of the screen where subtitles are displayed is ensured as area (2). In this mode, scene changeover detection of area (1) is overall scene changeover detection, and a scene changeover in area (2) is ignored. With this setting, a subtitle changeover is not erroneously recognized as a scene changeover.

Also in a general mode, an area where a telop is inserted or OSD (On-Screen Display) is frequently displayed can be so set as not to be used for the average brightness for scene changeover detection.

This can prevent any visual disturbance of greatly changing the brightness suppression coefficient by a scene changeover in another region though a scene in an area of interest does not change.

(Fifth Embodiment)

Figure 6:
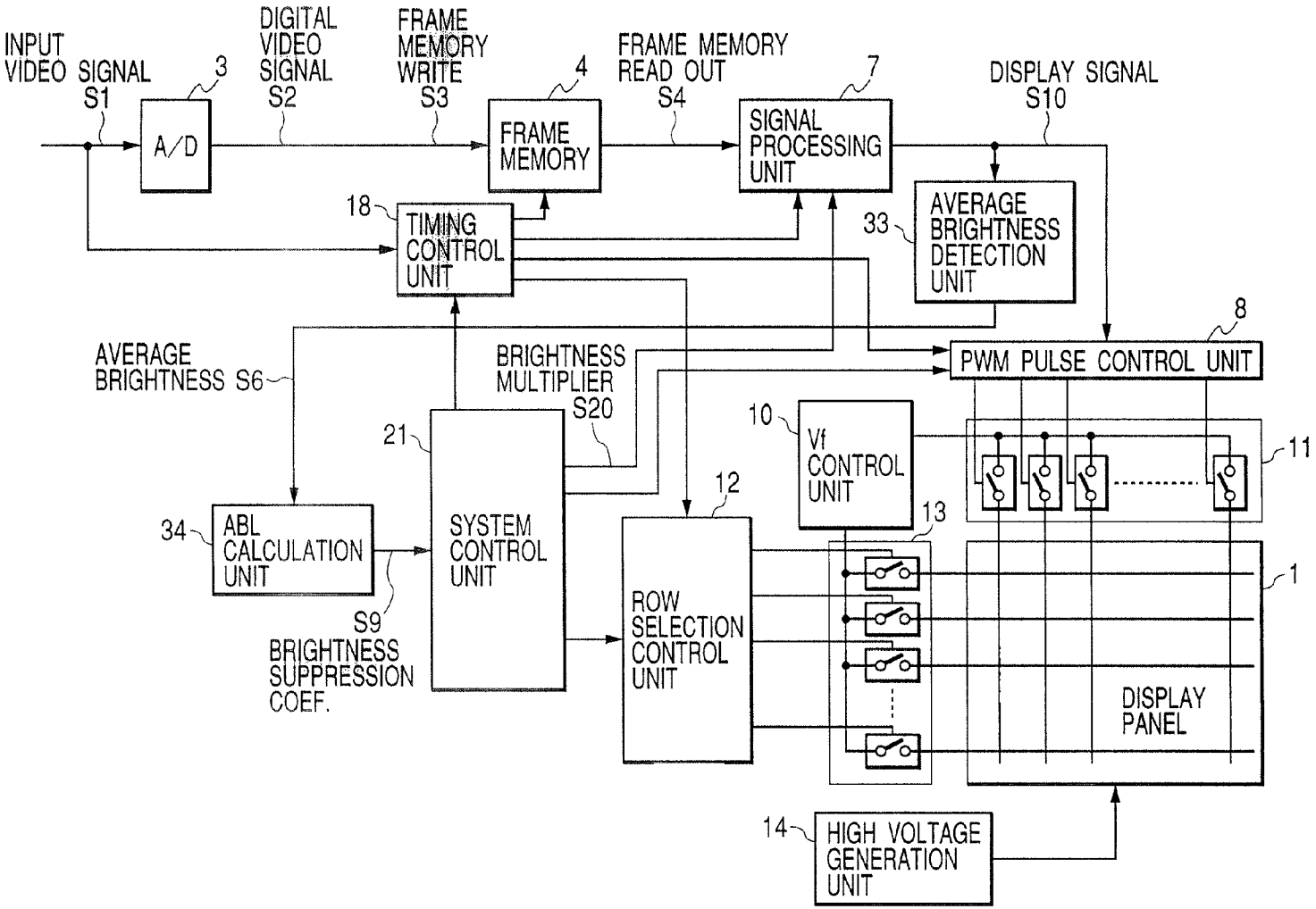
FIG. 6 is a block diagram showing the arrangement of the fifth embodiment.

FIG. 6 shows the arrangement of an image display according to the fifth embodiment. In FIG. 5, the same reference numerals as in FIG. 1 denote the same parts, and a description thereof will be omitted.

In the first embodiment, the average brightness S6 is calculated from the digital video signal S2 immediately after the input signal S1 is digitized by the A/D converter 3. In the fifth embodiment, the average brightness is calculated from the display signal S10 having undergone brightness/chromaticity adjustment, gamma processing, edge emphasis processing, and character information synthesis by a signal processing unit 7, and input to an ABL calculation unit 34.

The fifth embodiment adopts feedback control, and the normal value K(t) of the brightness suppression coefficient is given by $$K(t)=\mathrm{MIN}(Bm*K'(t-1)/B(t),1) \tag{7}$$

where B(t) is the frame average value of the display signal S10 output from the signal processing unit 7, and MIN(a,b) is a function of feeding back a smaller one of a and b.

The remaining arrangement is the same as that of the first or second embodiment.

In a device having a linear emission characteristic to a display video signal, inverse γ conversion with respect to the γ characteristic of a CRT must be performed within the signal processing unit 7. Through the inverse γ conversion, the average brightness level of a display signal actually supplied to the display panel becomes much lower than that of an input video signal. Calculating the average brightness level after inverse γ conversion from the average brightness level of an input video signal increases an error. The fifth embodiment calculates an average brightness after inverse γ conversion processing, and can realize accurate control.

The ratio of the display area of OSD (On-Screen Display) to the display area of the device increases to a non-negligible degree in ABL. However, the fifth embodiment calculates an average brightness from an actual display signal also considering OSD, and can achieve accurate control.

(Sixth Embodiment)

Depending on the characteristics of an image display, a high average brightness of the display screen increases power consumption, applying a load to a high voltage generation unit 14. The ABL response speed is desirably high, but the response speed need not be high for a low brightness. In this case, the time constant is set to different values between high and low brightness suppression coefficients, which can also be realized by the arrangements of the above-described embodiments.

In the sixth embodiment, the gains G and g in equations (4) and (6) are switched depending on the situation. Let Gu and gu be gains for increasing the brightness suppression coefficient, and Gd and gd be gains for decreasing the brightness suppression coefficient. Equation (8) is applied depending on the relationship between the normal value K(t) of the brightness suppression coefficient of the current frame and the brightness suppression coefficient K'(t−1) output for the preceding frame that is calculated by equation (2) or (7):

$$G=Gu, g=gu \ (\text{for } K(t)>K'(t-1))$$

$$G=Gd, g=gd \ (\text{for } K(t)\leqq K'(t-1)) \tag{8}$$

Based on equation (8), the brightness suppression coefficient K'(t) of the current frame is calculated using equations (4) and (6), and output to a system control unit 21.

(Seventh Embodiment)

In the above embodiments, the brightness component of a video signal is changed as a means for controlling the emission brightness of the display panel. As the emission brightness control means, another method can also be employed.

Figure 7:
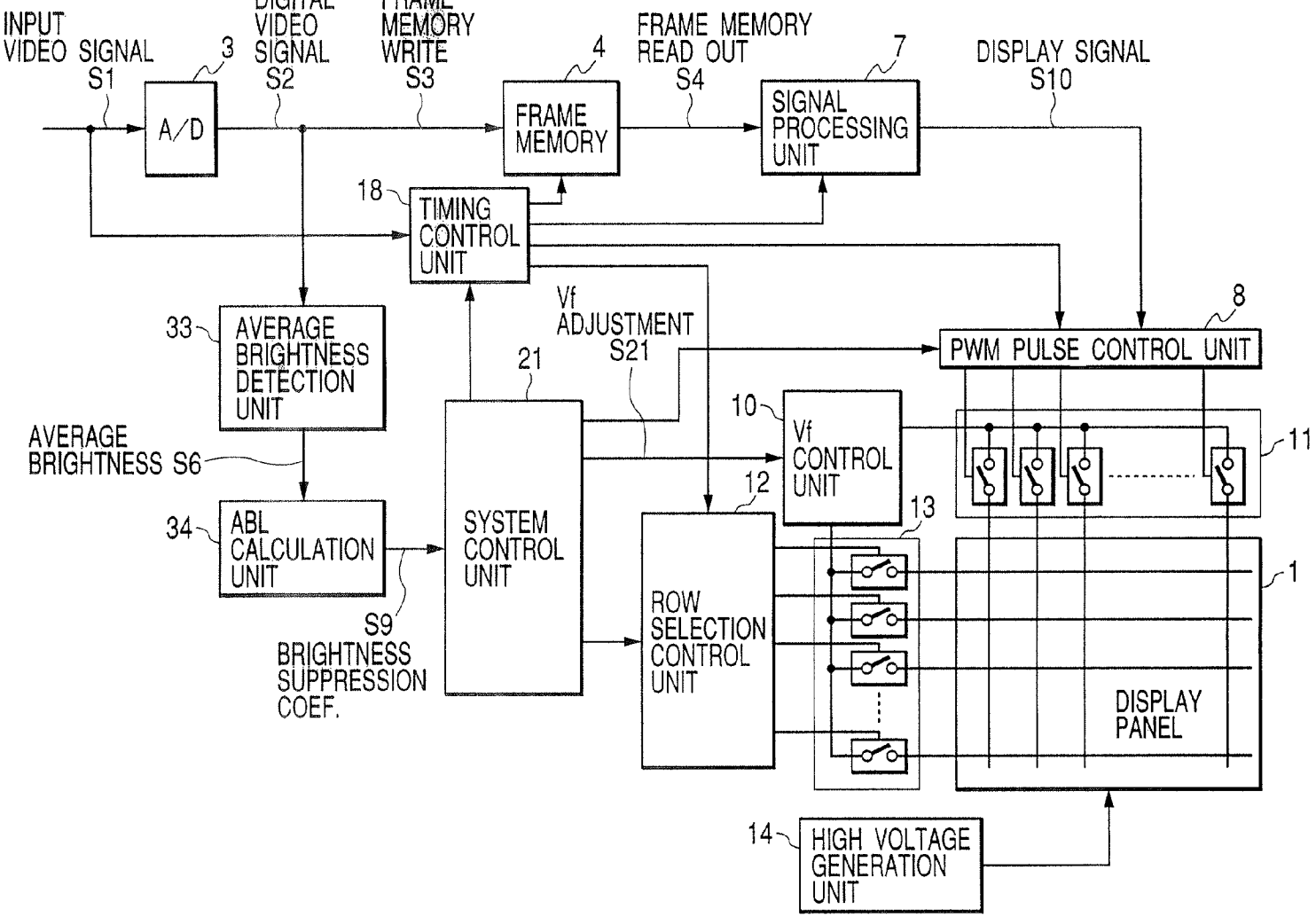
FIG. 7 is a block diagram showing the arrangement of the seventh embodiment.
Figure 8:
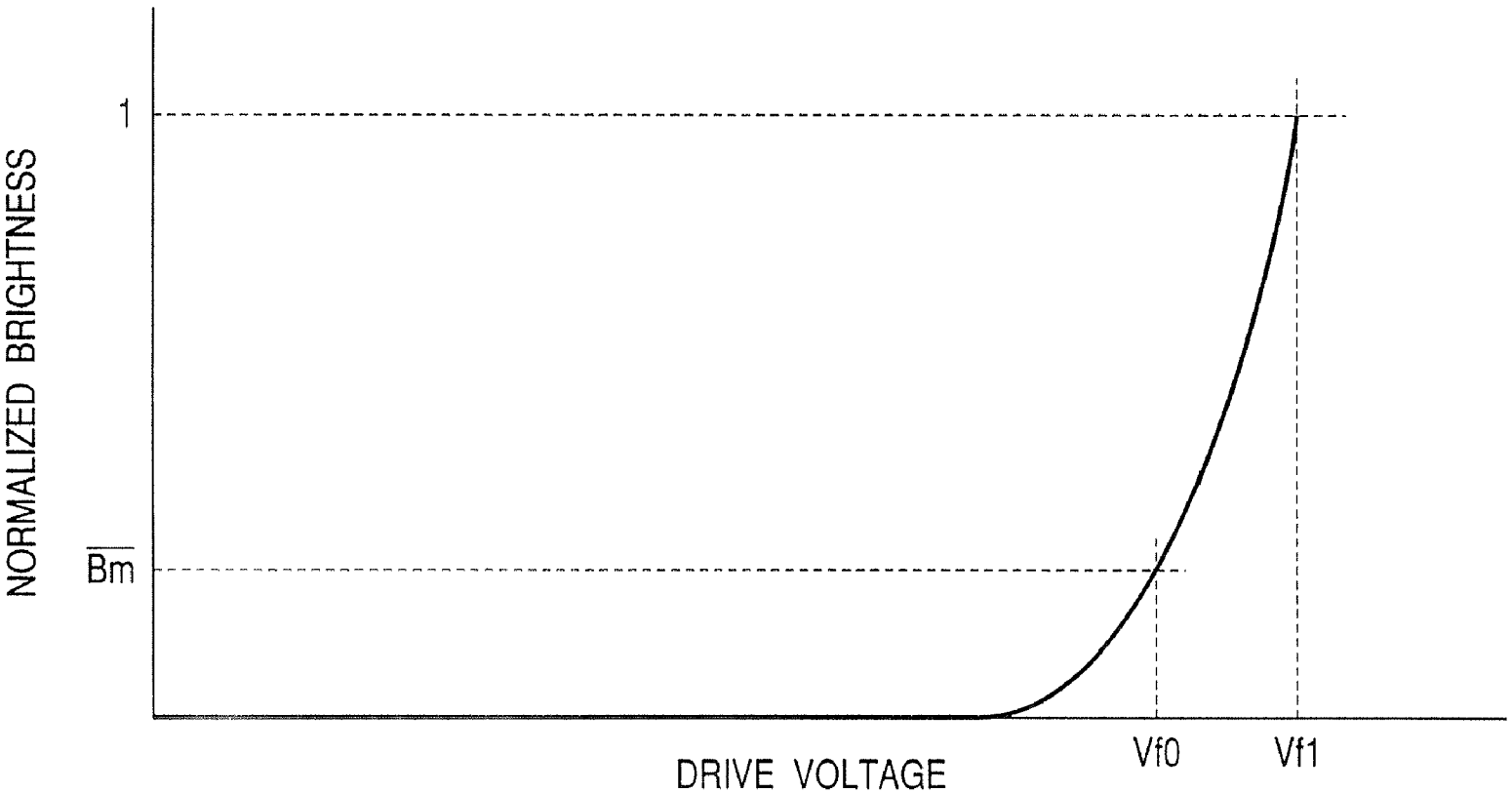
FIG. 8 is a graph showing the typical characteristic of the brightness of the display panel used in the embodiment to the drive voltage.

In the seventh embodiment, the emission brightness is controlled by controlling a voltage which is output from a Vf control unit 10 and drives electron-emitting devices on a display panel 1. FIG. 7 shows the arrangement of a display according to the seventh embodiment. A system control unit 21 sets the brightness suppression coefficient S9 for the Vf control unit 10. The Vf control unit 10 uses the brightness suppression coefficient S9 as a voltage adjustment value (S21) for driving electron-emitting devices, and outputs a voltage for driving the display panel 1. If the device voltage application time is constant, the screen brightness changes depending on a device voltage Vf, as shown in FIG. 8. A drive voltage Vf(t) is determined using the brightness suppression coefficient K'(t) calculated by equations (3) to (7).

As the determination method, for example, a table may be looked up, or the drive voltage may be calculated using an equation. In FIG. 8, the normalized brightness reference is given by Bm Then, the drive voltage used falls within a range of Vf0 to Vf1. By linearly approximating this range, Vf(t) is given by $$Vf(t)=K'(t)-Bm*(Vf1-Vf0)/(1-Bm)+Vf0 \tag{9}$$

The voltage range in FIG. 8 may be approximated not only by linear approximation but also by a polygonal line or a higher order equation.

With this control, the brightness can be controlled by changing a voltage applied to a row to be selected. The brightness need not be adjusted for each pixel, simplifying control.

The brightness suppression means in the seventh embodiment is implemented by the system control unit and Vf control unit.

(Eighth Embodiment)

Figure 9:
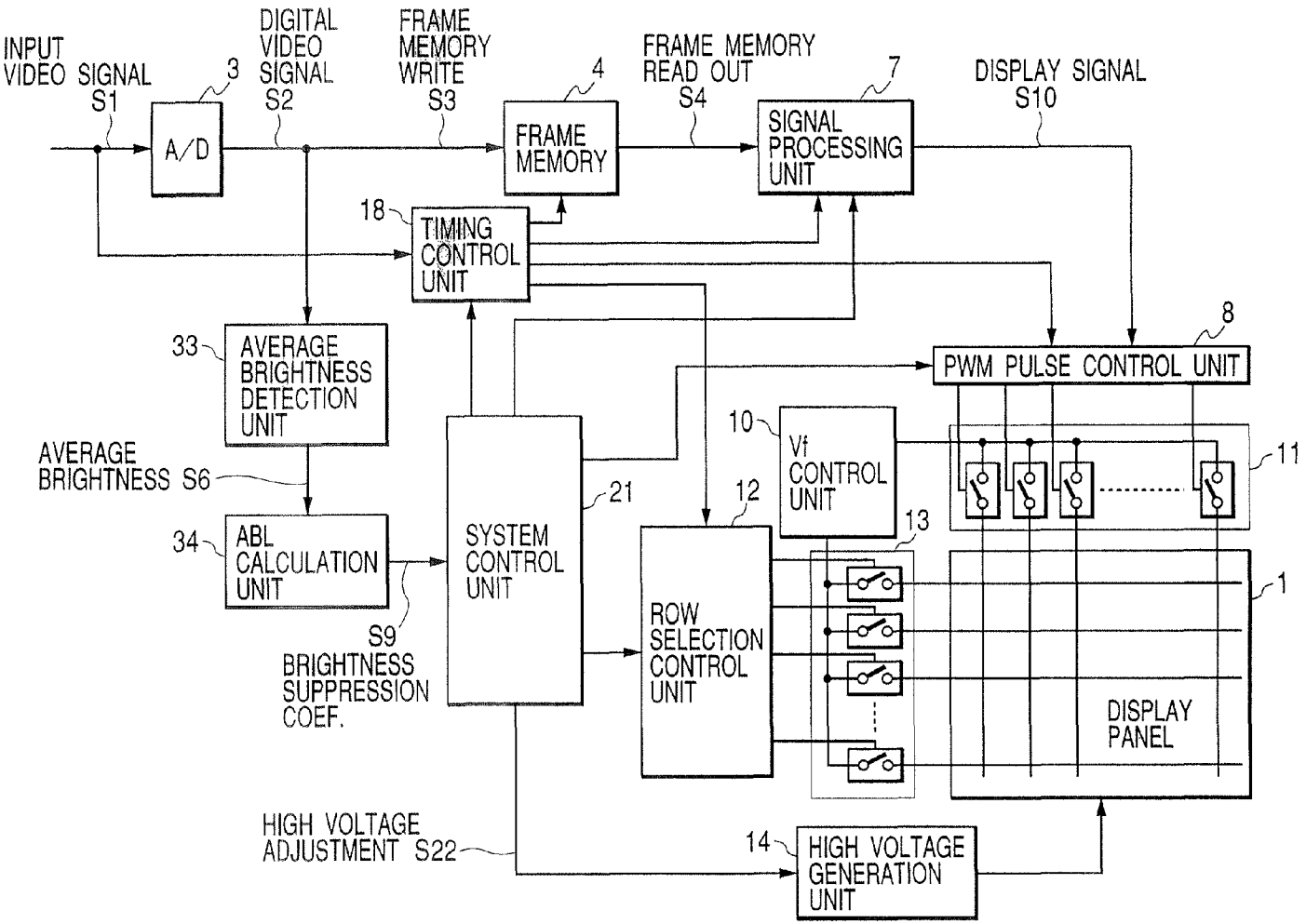
FIG. 9 is a block diagram showing the arrangement of the eighth embodiment.

An emission brightness control means for controlling a voltage which is output from a high voltage generation unit 14 and accelerates electrons emitted by electron-emitting devices on a display panel 1 can also be implemented by the same arrangement. FIG. 9 shows the arrangement of the eighth embodiment.

Figure 10:
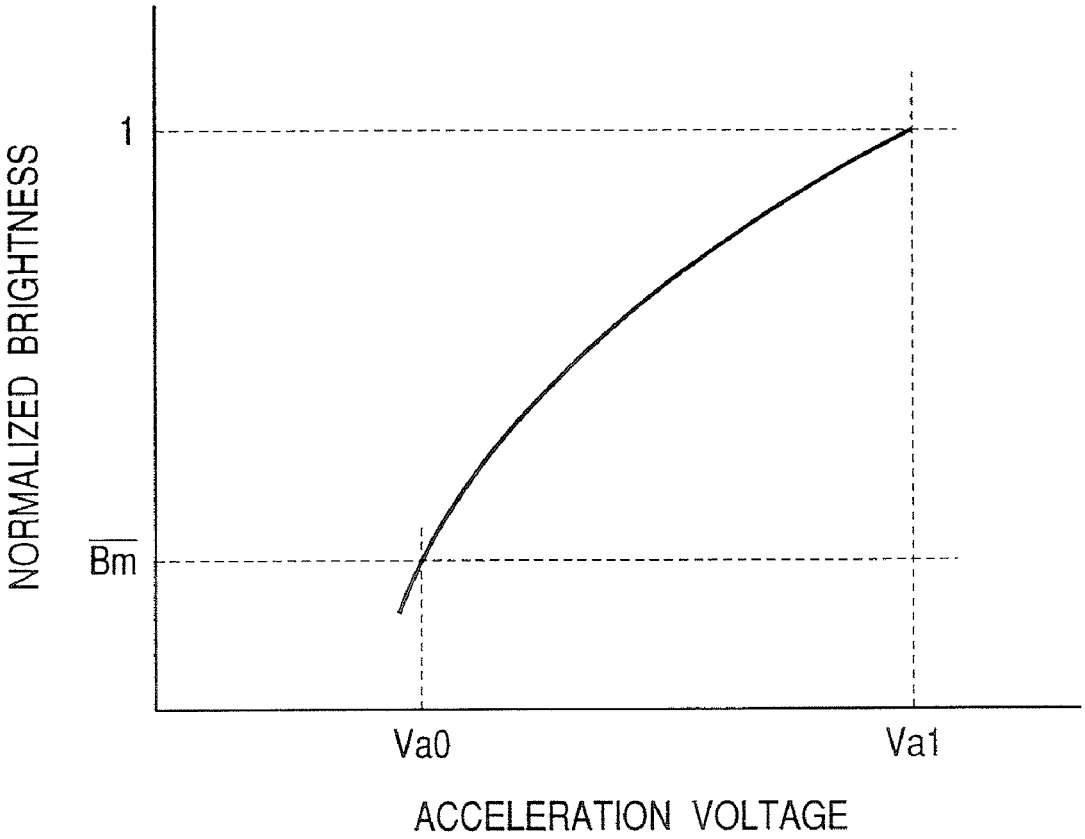
FIG. 10 is a graph showing the typical characteristic of the brightness of the display panel used in the embodiment to the acceleration voltage.

A system control unit 21 sets the brightness suppression coefficient S9 for the high voltage generation unit 14. The high voltage generation unit 14 uses the brightness suppression coefficient S9 as an acceleration voltage adjustment value for accelerating electrons, and outputs an acceleration voltage. Energy applied to the phosphor is controlled by the electron acceleration voltage, and the emission brightness is determined by the energy applied to the phosphor. If the device voltage application time is constant, the screen brightness changes depending on an acceleration voltage Va, as shown in FIG. 10. An acceleration voltage Va(t) can be determined using the brightness suppression coefficient K'(t), as described for the drive voltage Vf in the seventh embodiment.

This method can also be applied to a display using a CRT which accelerates emitted electrons.

The brightness suppression means in the eighth embodiment is implemented by the system control unit 21 and high voltage generation unit 14.

(Ninth Embodiment)

Figure 11:
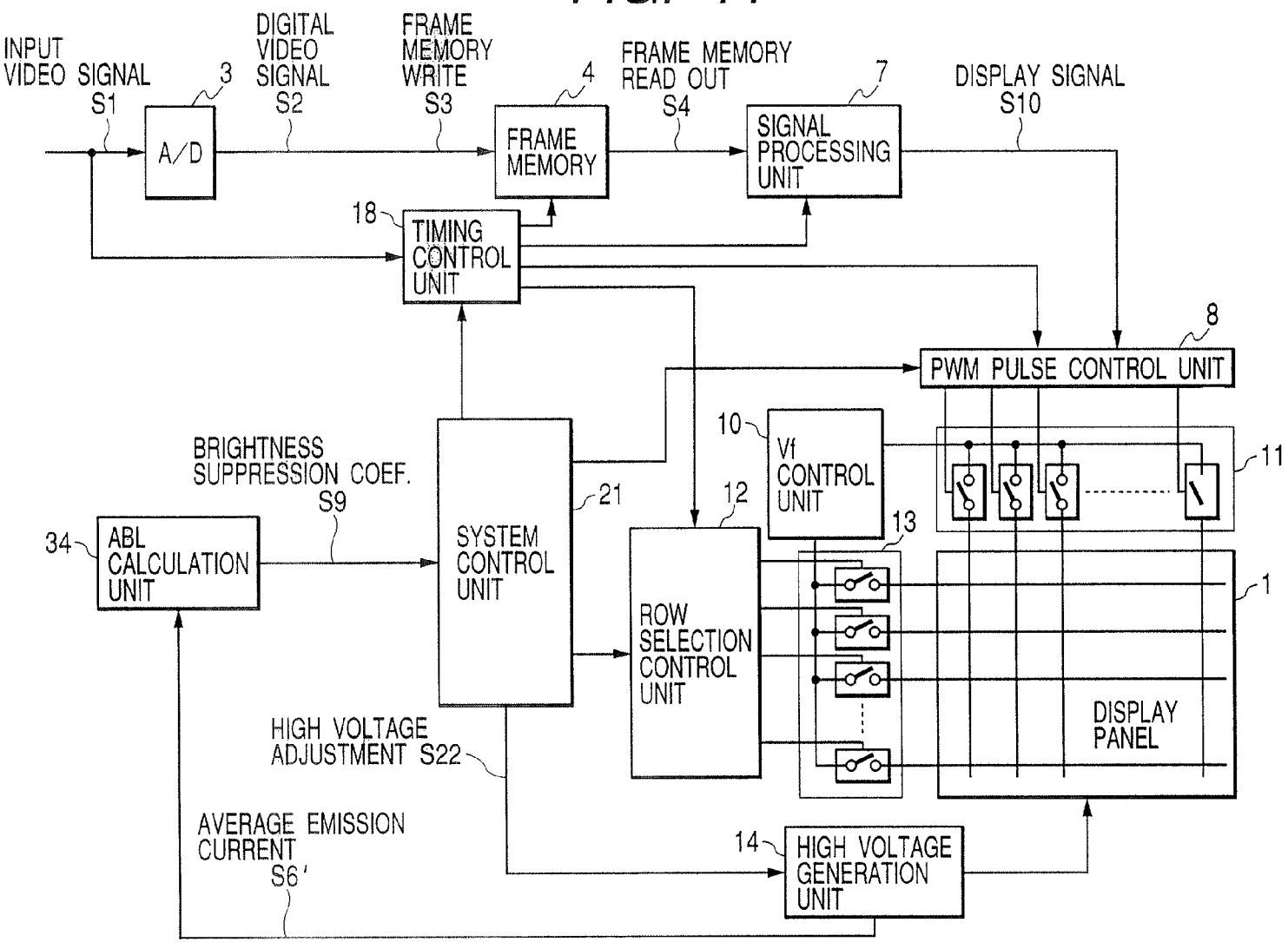
FIG. 11 is a block diagram showing the arrangement of the ninth embodiment.

An average value S6' of an emission current supplied from a high voltage generation unit 14 for electron-emitting devices may be detected instead of the average brightness S6. FIG. 11 shows the arrangement in this case. The high voltage generation unit 14 incorporates an emission current detection unit which detects an average current supplied to the display panel 1, and outputs the average emission current S6' to an ABL calculation unit 34. This arrangement is a feedback system, which can be implemented by using the same arrangement and equations except the average brightness detection unit 33 as those of the fourth embodiment, and replacing the average brightness S6 by the average emission current S6'.

According to the ninth embodiment, the brightness is measured from a current actually emitted in the display panel 1. This embodiment can effectively achieve the purpose of suppressing any increase in display power and heat generation.

The brightness information means in the ninth embodiment is implemented by the emission current detection unit in the high voltage generation unit 14.

In the above embodiments, the present invention is applied to a flat emission type image display which forms an image by irradiating the phosphor with an electron beam emitted by a plurality of electron-emitting devices arranged in a matrix. The present invention can also be applied by the same method as the first embodiment to another self-emission type image display such as a CRT, PDP, or electroluminescence device.

As has been described above, the present invention can suppress any increase in power consumption and heat generation on the display surface without any visual sense of incompatibility by controlling the display brightness in accordance with a display video signal without enlarging the circuit scale so as to prevent the average brightness of the entire display surface from increasing to a given value or more.

What is claimed is:

1. An image display control apparatus comprising:

brightness information means for obtaining brightness information corresponding to an average brightness of a display image, wherein the brightness information is based on a video signal which is obtained by one of the chromaticity adjustment processing, edge emphasis processing, and character information synthesis processing to input video signal;

detection means for detecting an image scene changeover; and brightness suppression means for suppressing a display brightness, wherein said brightness suppression suppresses the display brightness in response to the brightness information and detection of the scene changeover, and wherein said detection means detects the scene changeover on the basis of a difference between an average brightness of a frame of interest and an average brightness of an immediately preceding frame or on the basis of a second order differential of the average brightness.

2. An image display control apparatus comprising:

brightness information means for obtaining brightness information corresponding to an average brightness of a display image, wherein the brightness information is based on a video signal which is obtained by one of chromaticity adjustment processing, edge emphasis processing, and character information synthesis processing to an input video signal;

detection means for detecting an image scene changeover; and brightness suppression means for suppressing a display brightness, wherein said brightness suppression means suppresses the display brightness in response to the brightness information and detection of the scene changeover, and wherein said detection means determines the change amount of the average brightness for each component signal of an input video signal.

3. An image display control apparatus comprising:

brightness information means for obtaining brightness information corresponding to an average brightness of a display image, wherein the brightness information is based on a video signal which is obtained by one of chromaticity adjustment processing, edge emphasis processing, and character information synthesis processing to an input video signal;

detection means for detecting an image scene changeover; and brightness suppression means for suppressing a display brightness, wherein said brightness suppression means suppresses the display brightness in response to the brightness information and detection of the scene changeover, and wherein said brightness suppression means suppresses the brightness by changing a brightness component of a video signal.

4. A display comprising an image display control apparatus comprising brightness information means for obtaining brightness information corresponding to an average brightness of a display image, wherein the brightness information is based on a video signal which is obtained by one of chromaticity adjustment processing, edge emphasis processing, and character information synthesis processing to an input video signal, detection means for detecting an image scene changeover, and brightness suppression means for suppressing a display brightness, wherein said brightness suppression means suppresses the display brightness in response to the brightness information and detection of the scene changeover; and display means comprising a plurality of electron-emitting devices arranged in a matrix via column wiring and row wiring, and displays an image by irradiating phosphor with an electron beam emitted by the electron-emitting devices.

5. A display according to claim 4, wherein said brightness suppression means suppresses the brightness by changing a drive voltage of the electron-emitting devices.

6. A display according to claim 4, wherein said brightness suppression means suppresses the brightness by changing an acceleration voltage for accelerating electrons emitted by the electron-emitting devices.

7. A display according to claim 4, wherein the electron-emitting devices are surface conduction electron-emitting devices.

8. An image display apparatus comprising:

a plurality of electron-emitting devices connected via column wirings and row wirings;

phosphor for displaying an image by irradiating with an electron beam emitted by the electron-emitting device;

a circuit for obtaining brightness information corresponding to an average brightness of a display image, wherein the brightness information is based on an image signal which is obtained by gamma processing to an input image signal; and a brightness suppression circuit for suppressing a display brightness, wherein said brightness suppression circuit suppresses the display brightness in response to the brightness information and scene changeover detected based on the brightness information, and wherein the brightness information is based on the image signal which is obtained by gamma processing and at least one of brightness adjustment processing, chromaticity adjustment processing, edge emphasis processing, and character information synthesis processing to the input image signal.

9. An image display control apparatus comprising:

a circuit for obtaining brightness information corresponding to an average brightness of a display image, wherein the brightness information is based on an image signal which is obtained by gamma processing performed on an input image signal; and a brightness suppression circuit for suppressing a display brightness, wherein said brightness suppression circuit suppresses the display brightness in response to the brightness information and scene changeover detected based on the brightness information, and wherein the brightness information is based on the image signal which is obtained by gamma processing and at least one of brightness adjustment processing, chromaticity adjustment processing, edge emphasis processing, and character information synthesis processing to the input image signal.

* * * * *